US007176386B1

(12) United States Patent
Aidam et al.

(10) Patent No.: US 7,176,386 B1
(45) Date of Patent: Feb. 13, 2007

(54) MAGNETICALLY SHIELDED CONTAINER

(75) Inventors: Elke Aidam, Wörth (DE); Michael Ebert, Wörrstadt (DE); Tino Grossmann, Mainz (DE); Werner Heil, Varces Alliers et Risset (FR); Ernst-Wilhelm Otten, Mainz (DE); Daniela Rohe, Koblenz (DE); Reinhard Surkau, Mainz (DE)

(73) Assignee: Helispin Polarisierte Gase GmbH, Mainz (DE)

( * ) Notice: Subject to any disclaimer, the term of this patent is extended or adjusted under 35 U.S.C. 154(b) by 0 days.

(21) Appl. No.: 09/509,317

(22) PCT Filed: Sep. 24, 1998

(86) PCT No.: PCT/EP98/06056

§ 371 (c)(1),
(2), (4) Date: Feb. 2, 2001

(87) PCT Pub. No.: WO99/17304

PCT Pub. Date: Apr. 8, 1999

(30) Foreign Application Priority Data

Sep. 26, 1997 (DE) ..... 197 42 548

(51) Int. Cl.
*H05K 9/00* (2006.01)
*G21F 5/06* (2006.01)
*G01V 3/14* (2006.01)

(52) U.S. Cl. ..... 174/391; 250/515.1; 324/318

(58) Field of Classification Search ..... 174/350, 174/353, 377, 388, 391; 250/515.1, 505.1; 324/200, 207.11, 260, 300, 318, 319, 320
See application file for complete search history.

(56) References Cited

U.S. PATENT DOCUMENTS 2,743,507 A * 5/1956 Kornei ..... 174/350
2,864,963 A * 12/1958 Dornstreich et al. ..... 174/391

(Continued)

FOREIGN PATENT DOCUMENTS

EP 0 540 392 10/1992

OTHER PUBLICATIONS

M. Ebert et al., "Nuclear magnetic resonance imaging with hyperpolarized helium-3", May 11, 1996, vol. 347, pp. 1297-1299.

*Primary Examiner*—Dean A. Reichard
*Assistant Examiner*—Adolfo Nino
(74) *Attorney, Agent, or Firm*—Watov & Kipnes P.C.

(57) ABSTRACT

The invention provides a magnetically shielded container (1) having disposed in parallel opposed position on an axis (S) thereof magnetic field homogenizing pole shoes (10.1, 10.2), having disposed about said pole shoes a magnetically shielded yoke (2), said pole shoes and yoke enclosing a magnetic chamber (26), said container further comprising magnetic field sources (2.4, 2.5) disposed about and radially distanced from said axis whereby there exists within said chamber substantially homogenous magnetic field $B_o$ oriented in the direction of said axis and whereby there is a usable volume within said chamber where the ratio of the magnetic field gradient in the direction transverse to said axis to said magnetic field $B_o$ has a value of no more than $1.5\times10^{-3}$/cm. By virtue of the very low ratio of weight to volume that is achievable with this construction, the containers according to the invention are economical to produce and especially suited to transporting polarized gasses.

44 Claims, 6 Drawing Sheets

Figure 1:
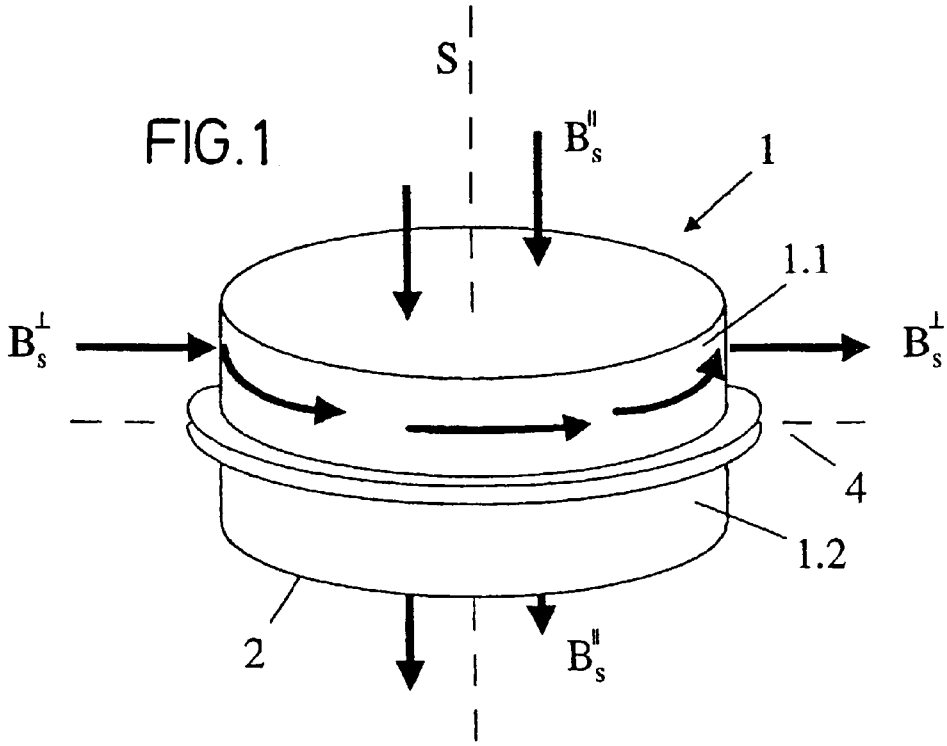

U.S. PATENT DOCUMENTS 3,756,915 A * 9/1973 Matveevich et al. ..... 250/515.1
3,800,158 A 3/1974 Grosbard
4,642,569 A * 2/1987 Hayes et al. ..... 324/318
5,043,529 A 8/1991 Vanesky et al.
5,187,327 A * 2/1993 Ohta et al. ..... 174/391
5,539,367 A * 7/1996 Xu et al. ..... 324/318
6,670,547 B2 * 12/2003 Kageyama ..... 174/381
6,826,828 B1 * 12/2004 Shen ..... 174/388
6,864,418 B2 * 3/2005 Wang et al. ..... 174/391

* cited by examiner

MAGNETICALLY SHIELDED CONTAINER

The invention relates to a magnetically shielded container, e.g. usable as a transport device for spin polarized gases, and to a storage cell useful therein.

Nuclear spin polarized gases, in particular noble gases such as the helium isotope with the mass number 3 ($^{3}$He) or the xenon isotope with the mass number 129 ($^{129}$Xe) and gases containing the fluorine, carbon or phosphorus isotopes $^{19}$F, $^{13}$C or $^{31}$P are required for a great number of experiments in fundamental physics research. In the field of medicine, such isotopes are, in particular, considered for use in nuclear magnetic resonance imaging, of the lungs for example. (See for example WO 97/37239, WO 95/27438, Bachert et al., Mag Res Med 36: 192–196 (1996) and Ebert et al., The Lancet 347: 1297–1299 (1996)). A prerequisite for the use of such spin polarized gases in nuclear magnetic resonance imaging is that the degree of polarization P of the spin I of the nuclei, or the associated magnetic dipole moment $\mu_I$, is greater by an order of 4–5 than is normally achieved in thermal equilibrium in the magnetic field $B_T$ of the magnetic resonance imaging apparatus. This normal degree of polarization, $P_{Boltzmann}$, is dependent on the magnetic dipole energy $-\mu_I B_T$ and average thermal energy kT:

$$P_{Boltzmann}=tanh(\mu_I B_T/kT) \quad (1)$$

(where k=Boltzmann's constant, and T=absolute temperature).

Where $P_{Boltzmm}<<1$, then it approximates to $\mu_I B_T/kT$.

Whereas the hydrogen isotope $^{1}$H used in magnetic resonance imaging of tissues only reaches a $P_{Boltzmann}$ of $5\times10^{-6}$ at $B_T$=1.5 T and T=300 K, a $P\geqq1\times10^{-2}$, i.e. 1%, is required in gas magnetic resonance imaging. The requirement for such an extremely increased P primarily results from the low concentration of the gas atoms in comparison with that of the hydrogen in the tissue. Gases with such degrees of polarization (normally referred to as hyperpolarized gases) can be produced by means of various known methods, preferably optical pumping.

In addition, for gas magnetic resonance imaging relatively large quantities of gas, of the volume of a breath for example (0.5 to 1 liter), are needed.

Particularly high degrees of polarization, for example >30%, combined with high rates of production, e.g. 0.5 liters/h, may be achieved through compression of an optically-pumped gas. This process is described in the following publications, the content of which is incorporated herein by reference:

Eckert et al., Nuclear Instruments and Methods in Physics Research A 320: 53–65 (1992);

Becker et al., J. Neutron Research 5; 1–10 (1996);

Surkau et al., Nuclear Instruments and Methods in Physics Research A 384: 444–450 (1997);

Heil et al., Physics Letters A 201: 337–343 (1995).

However production and use of hyperpolarized gases do not necessarily occur at the same site and the problem thus arises of transporting the polarized gases, produced for example using the method described above, to the consumer, for example for use in a nuclear magnetic resonance imaging apparatus for the lungs.

Previously, transportable magnetic devices which provide a sufficiently homogeneous magnetic holding field for a large storage volume of such a spin polarized gas were not available. Furthermore, the nuclear spins very rapidly depolarized on the cell walls, so that polarized gases could only be stored for a short time while retaining the necessary degree of polarization.

One problem addressed by the invention is to provide a magnetic device capable of providing a transportable, homogeneous magnetic holding field for a sufficiently large storage volume of hyperpolarized gas.

Viewed from one aspect the invention thus provides a magnetically shielded container having disposed in parallel opposed position on an axis thereof magnetic field homogenizing pole shoes, having disposed about said pole shoes a magnetically shielding yoke, said pole shoes and yoke enclosing a magnetic chamber, said container further comprising magnetic field sources disposed about and radially distanced from said axis whereby there exists within said chamber a substantially homogeneous magnetic field $B_o$ oriented in the direction of said axis and whereby there is a usable volume within said chamber where the ratio of the magnetic field gradient in the direction transverse to said axis to said magnetic field $B_o$ has a value of no more than $1.5\times10^{-3}$/cm.

Such a container may be constructed in a form which is low in weight, simple in structure, and inexpensive to manufacture and economical in use. Furthermore, using the container, nuclei which are transported can, as far as possible, retain their orientation, even in external stray fields, i.e. the depolarization relaxation times may be as long as possible in order to prevent a disorientation of the nuclear spin of the gas.

The container of the invention, which is suitable for containing and transporting spin polarized atoms, especially polarized $^{3}$He and $^{129}$Xe, is preferably provided with magnetic field homogenising, highly-permeable and magnetically soft plates, e.g. of p-metal or soft iron, as pole shoes, and is so structured that a very large ratio can be achieved between the usable volume, within which a sufficiently homogeneous magnetic field is present, and the total volume, e.g. a ratio of at least 1:30. However, this ratio is preferably at least 1:5, more preferably 1:3 and, particularly advantageously 1:2. A ratio of 1:1.5 can be achieved. A value of $$G_r=((\delta B_r/\delta r)/B_o)\leqq1.5\times10^{-3}/\text{cm} \quad (2)$$

is hereby applied as a homogeneity condition within the usable volume for the relative transverse gradient $G_r$ of the magnetic field $B_o$. This requirement results from the gradient-dependent relaxation time $T_{1G}$, which (at high pressures, such as those the present invention is concerned with) is related as follows to $G_r$ and the gas pressure p:

$$T_{1G}=p/G_r^2\times(1.75\times10^4\ \text{cm}^2\ \text{bar/h})^{-1} \quad (3)$$

(see Scherer et al., Phys Rev 139: 1398 (1965)).

According to equation (3), with $G_r 1.3\times10^{-3}$/cm and p=3 bars, a gradient-dependent relaxation time $T_{1G}$>76 h is achieved.

At lower pressures, $T_{1G}=p/G_r^2\times(1.8\times10^3\ \text{cm}^2\ \text{bar/h})^{-1}$ (see Barbe, Journal de Physique 35: 699 and 937 (1974)).

During the movement of a polarized gas storage cell into the container of the invention, $G_r$ will generally be less than $0.02\times10^{-3}$/cm. In this way $^{3}$He at 3 bar loses only 2% polarization per 30 seconds.

Within the container according to the invention, $G_r$ is preferably no more than $1.3\times10^{-3}$/cm, more preferably no more than $7\times10^{-4}$/cm. With a gas storage cell radius of 8 cm, $G_r$ of $\leqq1.3\times10^{-3}$/cm corresponds to $T_{1G}$ of $\geqq127$ hours, while with a gas storage cell radius of 2 cm, $G_r$ of $\leqq 7\times10^{-4}$/cm corresponds to $T_{1G}$ of $\geqq$350 hours.

In order to compensate field distortions in the marginal areas of the interior space of the container and thus improve the homogeneity of the magnetic field $B_o$, the container features magnetic field sources which are arranged in such a way that the field distortions in the marginal areas of the interior space of the container are minimal and the field in the interior of the container is largely homogeneous.

In order to maintain the polarization of the nuclear spin once it has been achieved, only a relatively weak homogeneous magnetic field is required which preferably displays a magnetic field strength of less than 5 mT, more preferably less than 1 mT, more especially in the range 0.2 to 0.9 mT. In such a weak magnetic field, continuous quality control of the degree of polarization can be achieved with the aid of measuring instruments, ensuring particular reliability. Thus in one preferred embodiment, a magnetic field sensor (e.g. one based on the Förster principle) is disposed in the container of the invention so as to allow determination of the magnetic field Bd generated by the hyperpolarized gas.

Whereas the generation of strictly homogeneous magnetic fields with the aid of ferromagnetic materials previously concentrated on high field strengths within the tesla range, the concept behind the container of the invention is deliberately focused on the most efficient and practical realisation of a weak, widely homogeneous magnetic field, e.g. using ferromagnetic materials.

A high degree of homogeneity can be achieved within the weak field range if, for example, as homogenising ferromagnetic elements, two thin soft iron, or more preferably μ-metal, plates are used as pole shoes. Such pole shoes, thanks to their extremely high permeability and low remanence, create a very homogeneous field within the intervening space, the magnetic chamber.

In a particularly preferred embodiment, the homogenising effect of these pole shoes can be increased by introducing magnetic resistances between the pole shoes and the yoke. A preferred material for a magnetic resistance of this sort, is a rigid non-magnetic layer, for instance in the form of a plate, for example of plastic, fitted between the pole shoe and the yoke. If such a plate or, in order to save weight, preferably a porous, e.g. honeycomb structure, is also bonded to the pole shoe, this guarantees its flatness which allows the pole shoes to be parallel and the field $B_o$ to be homogeneous.

In order to fulfil the aforementioned homogeneity conditions in the simplest possible manner, and at the same time to provide a large storage volume, it has proved especially preferable to design the container of the invention in the form of a pot magnet. A magnetic device of this sort consists essentially of a closed pot which, in an exemplary construction form, can have a diameter of 30–60 cm with an overall height of 10–30 cm. The particular advantage of designing the container in the form of a pot magnet lies in the high degree of symmetry of this cylindrical construction. Two possibilities can be considered as particularly preferred arrangements of the field sources in a pot magnet of this sort:

- positioning the field sources, for example in the form of commercially-available permanent magnetic plates, in a gap in the median or reflection plane of the pot; and
- positioning the field sources on the outer surface of the end plates of the pot.

By appropriately dividing the field sources between these two arrangements, on the one hand positioning the field sources in the median plane, on the other hand positioning the field sources on the outer surface of the end plates of the pot, it is possible to correct the boundary errors of the magnetic field inside the pot magnet and thus fulfil the homogeneity conditions over a wide range in a radial direction. A preferred division is such that the increase in the boundary field which occurs when the field sources are arranged in the reflective or median plane of the pot magnet is just compensated by the fall-off in the boundary field which occurs where the field sources are positioned on the end plate of the pot.

If desired, magnetic field sources may be placed elsewhere in the container of the invention so as to achieve an improvement in the homogenization of the applied field $B_o$. Thus for example such sources may be placed in further planes perpendicular to $B_o$ besides the planes of, adjacent to and mid-way between the pole shoes.

A particularly homogeneous boundary field is also achieved if a magnetic screen, e.g. a soft iron or μ-metal ring, is fitted between the pot and the rim of the pole shoe, so that an external stray field is partially short-circuited and, where the field sources are arranged on the median plane of the pot magnet, the value of the boundary field is reduced to the value of the central field in the centre of the pot magnet through appropriate dimensioning of the magnetic screen.

Advantageously, especially in the case of non-circular cylindrical (e.g hexagonal-cylindrical) containers according to the invention, shims (e.g. corner shims-positioned onto the pole shoes) may be used to improve field homogeneity within the magnetic chamber. Advantageously also the chamber has a high degree of azimuthal symmetry.

Two preferred construction forms can be used as magnetic field sources. In a first construction form, permanent magnets can be used, preferably commercially-available tablets, for example with a height of 5 mm and a diameter of 20 mm. In another construction form, these permanent magnets are replaced with appropriately-dimensioned magnetic field coils. Such magnetic field coils have the advantage that the desired magnetic fields can be adjusted by means of an appropriately-selected current flow. However, a disadvantage of the second construction form is that an additional current source must be carried with the container where it is used as a transport device rather than simply as a storage device.

The container is advantageously constructed using a yoke of a material which is not magnetically saturated at fields below 1 Tesla, more preferably 2 Tesla, e.g. a soft iron. The container dimensions are preferably such that the usable volume (within which the gas storage cell may be disposed) is at least 50 mL, more preferably 100 mL, especially preferably 200 mL to greater than 1 l, e.g. up to 20 l, more particularly 200–2000 ml. The materials used can allow a total container weight to magnetic chamber volume of no more than 1 kg/l, more preferably 0.2 kg/l, especially preferably 1/30 kg/l. The gas storage cell which can be disposed in the container, e.g. for storage or transport, preferably has an internal volume of at least 50 ml, e.g. 100 ml to 1 l, particularly 100 ml to 20 l, more particularly 200 mL to 2 l. This cell may be provided with a valve for allowing gas introduction and removal; alternatively it may be a single-use cell, e.g. provided with a sealable portion and a breakable portion (which may be the sealable portion after sealing).

In one embodiment, the container of the invention may take the form of a magnetic device with an internal space which provides a high-volume, largely homogeneous, shielded magnetic field within its interior, whereby the magnetic device features homogenising μ-metal plates as pole shoes, the magnetic device is characterised in that a ratio of 1:1.5 can be achieved between the useable volume of the magnetic device within which a homogeneous magnetic field is present and the overall volume of the magnetic device and the homogeneity condition $$G_r \leqq 1.5\times10^{-3}/\text{cm}$$

is fulfilled within the useable volume, where $G_r$ is the relative transverse magnetic field gradient.

Viewed from a further aspect, the invention also provides a gas storage cell containing a nuclear spin polarized gas in a gas storage space surrounded by a cell wall, the wall being of an uncoated material which on the surface contacting said gas storage space is substantially free of paramagnetic substances. The gas may for example be $^3$He or $^{129}$Xe, especially $^3$He. Using an essentially paramagnetic substance free cell wall makes it possible for polarized $^3$He to display a wall-related depolarization relaxation time $T_1^w$ of at least 20 hours. It is particularly preferable that the wall-related depolarization relaxation time be more than 50 hours. Such high depolarization relaxation times can be achieved if a material is used as cell wall material which contains a low proportion of paramagnetic atoms or molecules, whereby in a particularly preferred construction form glasses with very low iron concentrations, preferably less than 20 ppm, are used, which can also be composed in such a way that, at the same time, they represent an efficient diffusion barrier against helium, for example Supremex glass (manufactured by Schott, Mainz, Del.) of the type of the alumina silicate glasses. In comparison with the previously-known storage cells described by Heil et al. in Physics Letters A 201: 337–343 (1995), long wall-related depolarization relaxation times can be achieved using the storage cells in accordance with the invention, without complex metal coating of the walls being necessary.

As mentioned above, the container of the invention may take the form of a transport device for spin polarized gases, especially $^3$He and $^{129}$Xe or gases containing $^{19}$F, $^{13}$C or $^{31}$P, e.g. gases which have been spin polarized by polarization transfer. Within the area in the interior space of the container in which the storage cell is positioned, the magnetic field of the magnetic device can be so homogeneous that the depolarization relaxation time $T_1^g$ caused by a transverse magnetic field gradient in accordance with equation (3) is greater than 125 hours, especially greater than 200 hours, more particularly greater than 300 hours, preferably greater than 500 hours, particularly preferably greater than 750 hours, and the wall-related depolarization relaxation time $T_1^w$, due to impacts of the nuclear-polarized gas on the wall of the storage cell, is greater than 5 hours, preferably greater than 20 hours.

More preferably, $T_l^w$ normalized by the interior surface to volume ratio of the storage cell is preferably at least 10 h/cm.

However, depolarization losses occur not only during the transport of the gas, due to the influence of external stray magnetic fields and the resulting in homogeneity of the magnetic field, or due to collisions between the atoms and the wall, but, in particular, also when the gas is removed from the transport container.

Viewed from a still further aspect, the invention therefore provides a method for the removal of a nuclear spin polarized gas from a gas storage cell in a container comprising:

(i) positioning said container with its axis parallel to the field direction of an external substantially homogeneous magnetic field;

(ii) opening said container by removing a portion comprising one of said pole shoes; and (iii) removing said cell in the direction of said axis.

Such depolarization losses can be minimised if the removal of the polarized gas takes place according to this method.

In this method, the container, e.g. in the form of a pot magnet, is set up with its axis and the alignment of the internal, homogeneous magnetic field parallel to an external, adequately homogeneous magnetic field, which can, for example, be achieved with the aid of a Helmholz coil or the stray field of a nuclear magnetic resonance imaging apparatus. The half of the pot magnet facing the homogeneous magnetic field in an axial direction is then lifted off. The remaining half then guarantees a sufficient field homogeneity in the area of the gas cell through the magnetic equipotential surface of its pole shoe, which is made, for instance, of p-metal. The removal of the storage cell filled with polarized gas from the magnet can take place in an axial direction within a few seconds.

Figure 2:
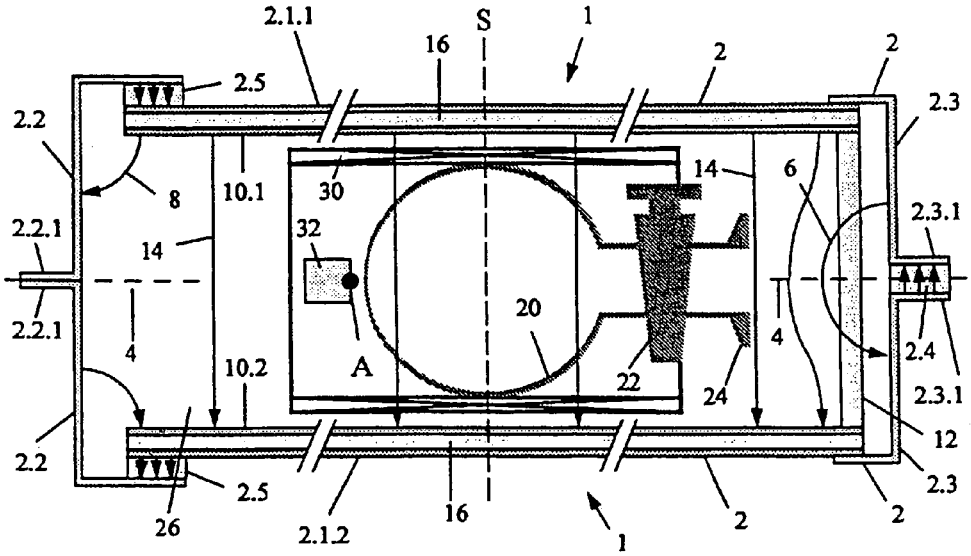
Figure 4:
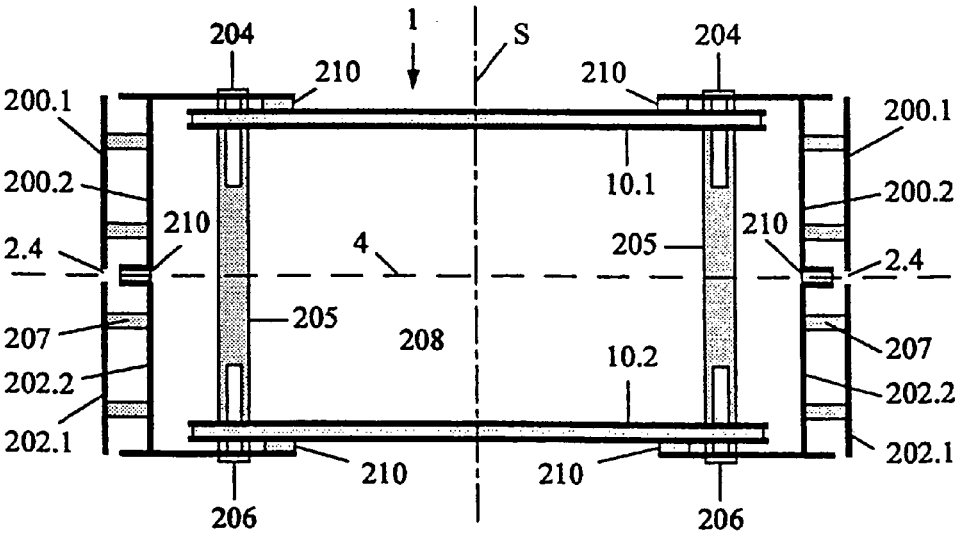
Figure 5A:
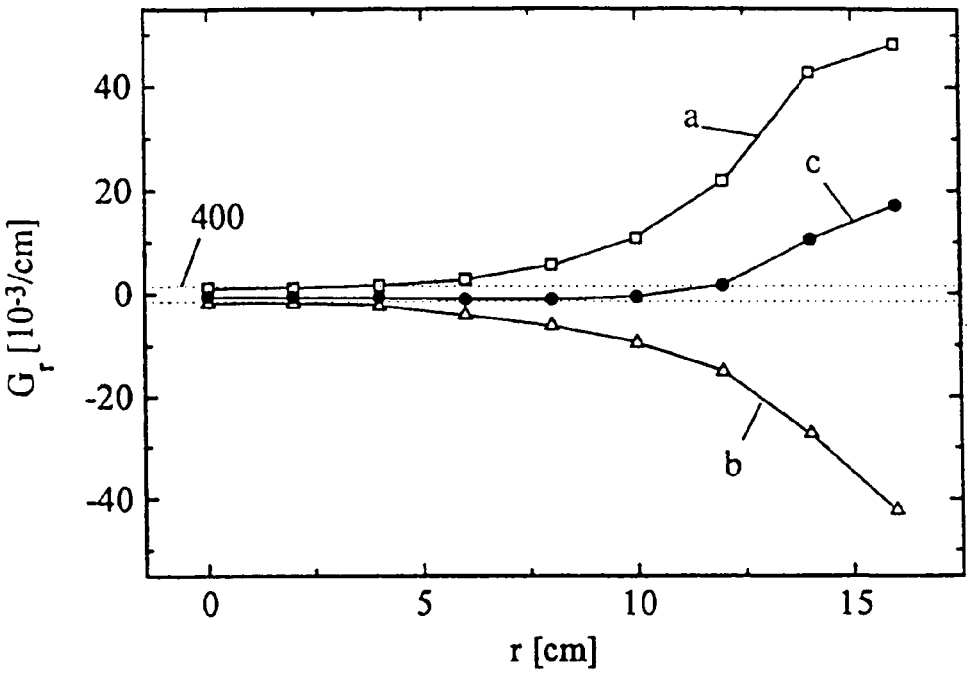
Figure 6:
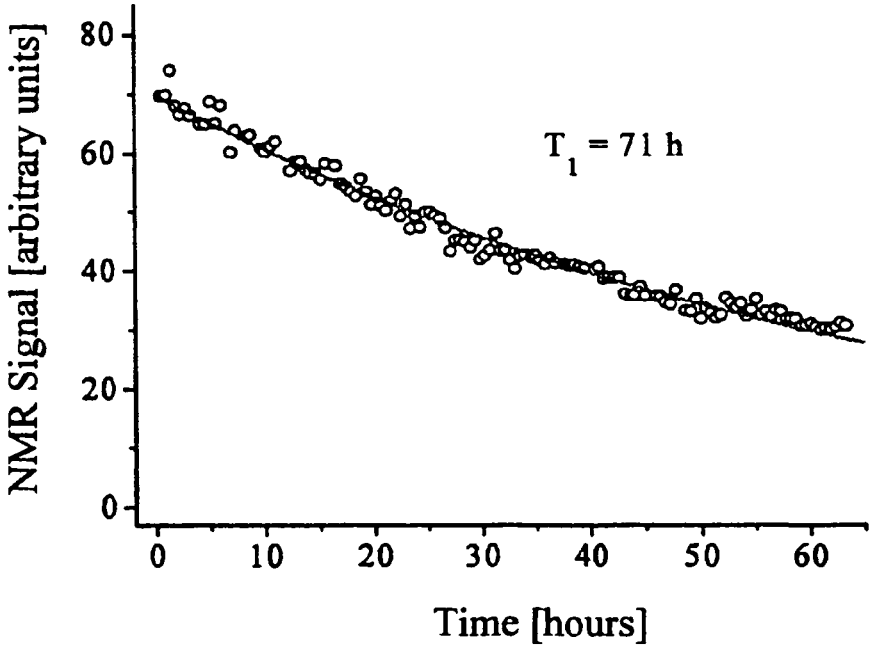
Figure 5B:
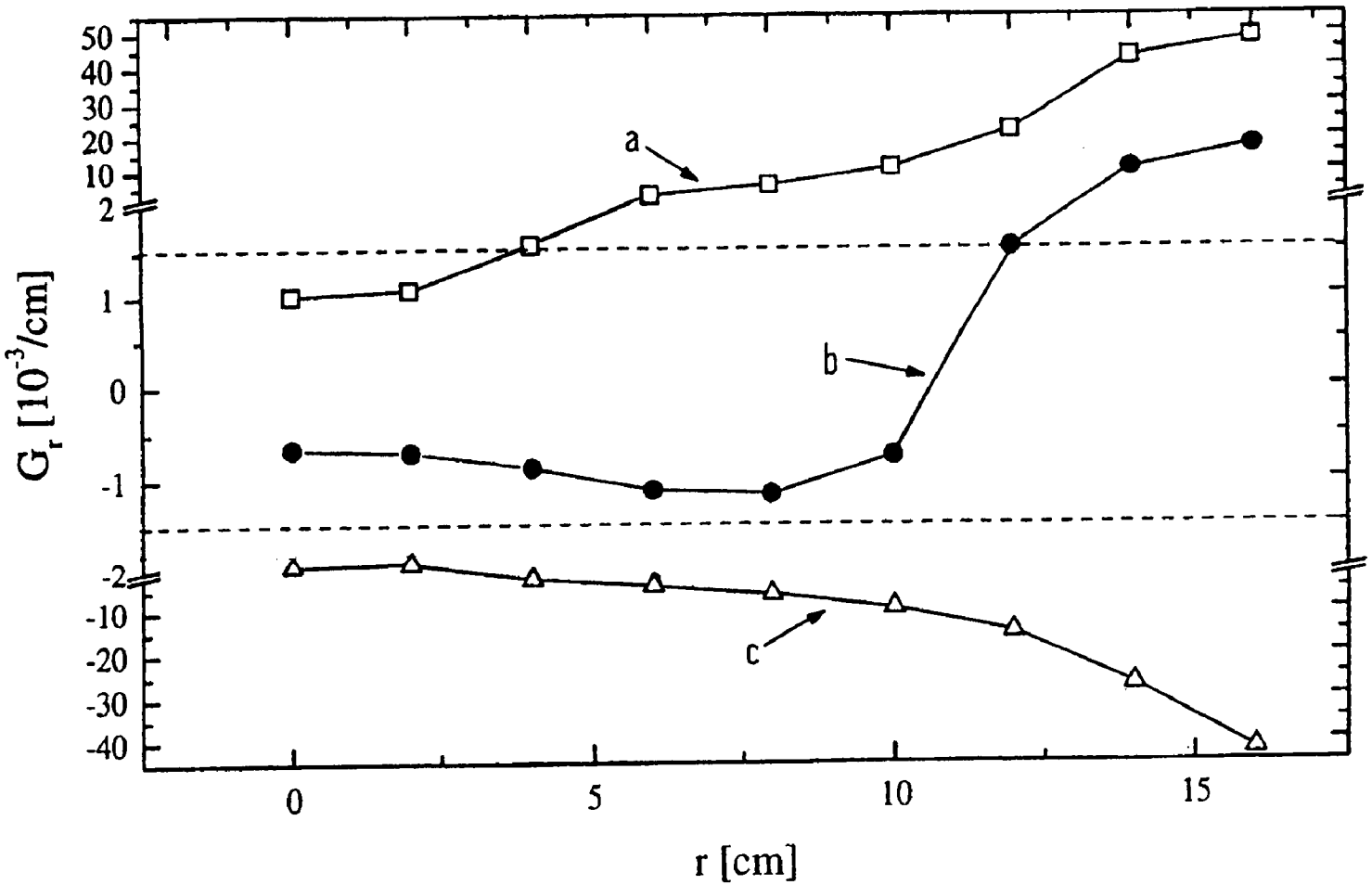
Figure 7A:
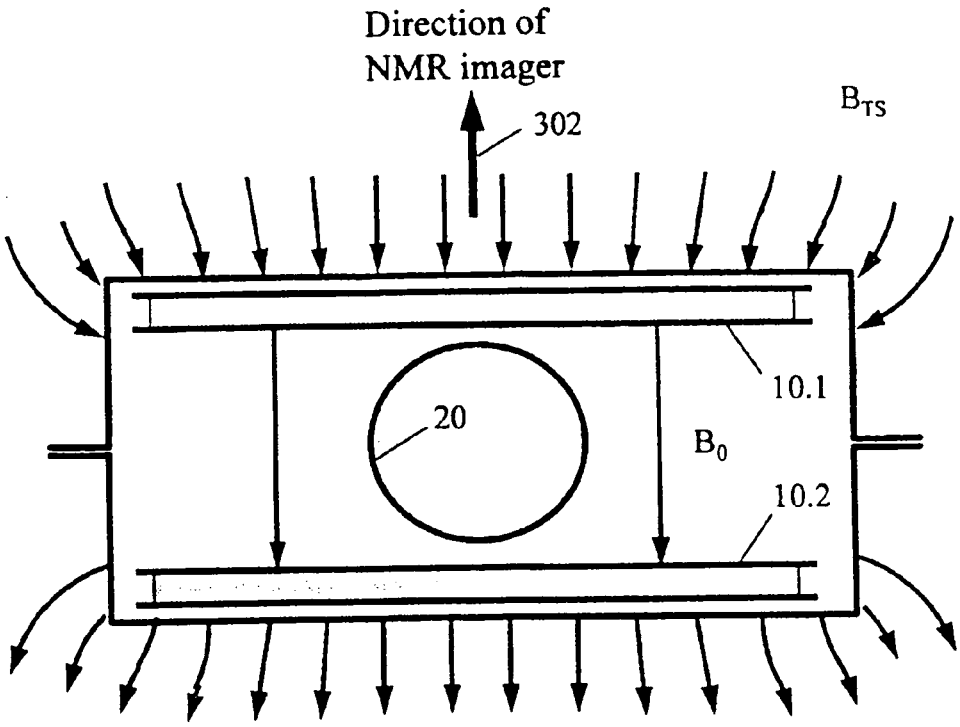
Figure 7B:
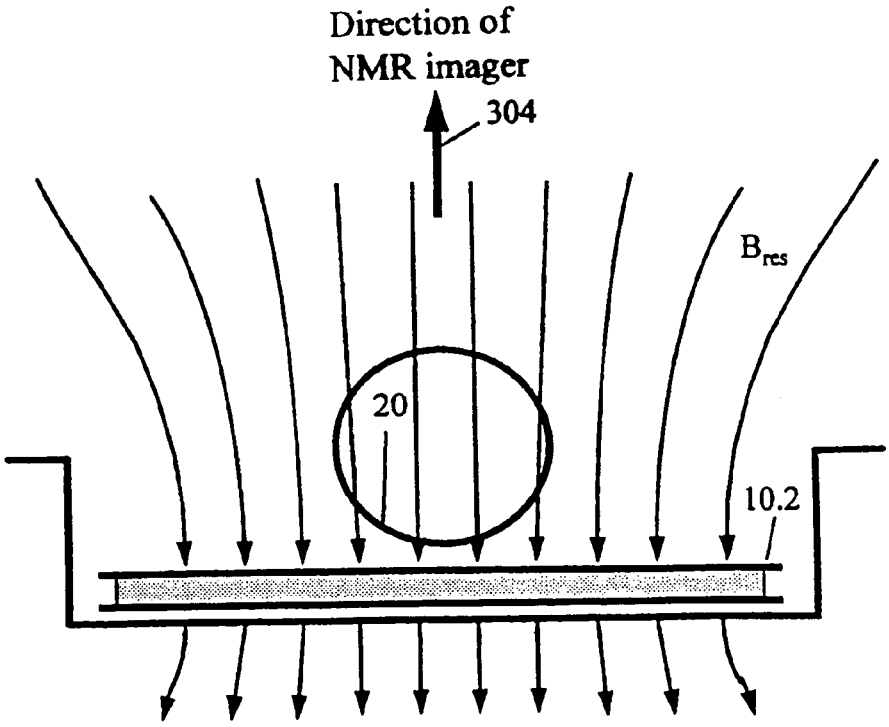
Figure 8:
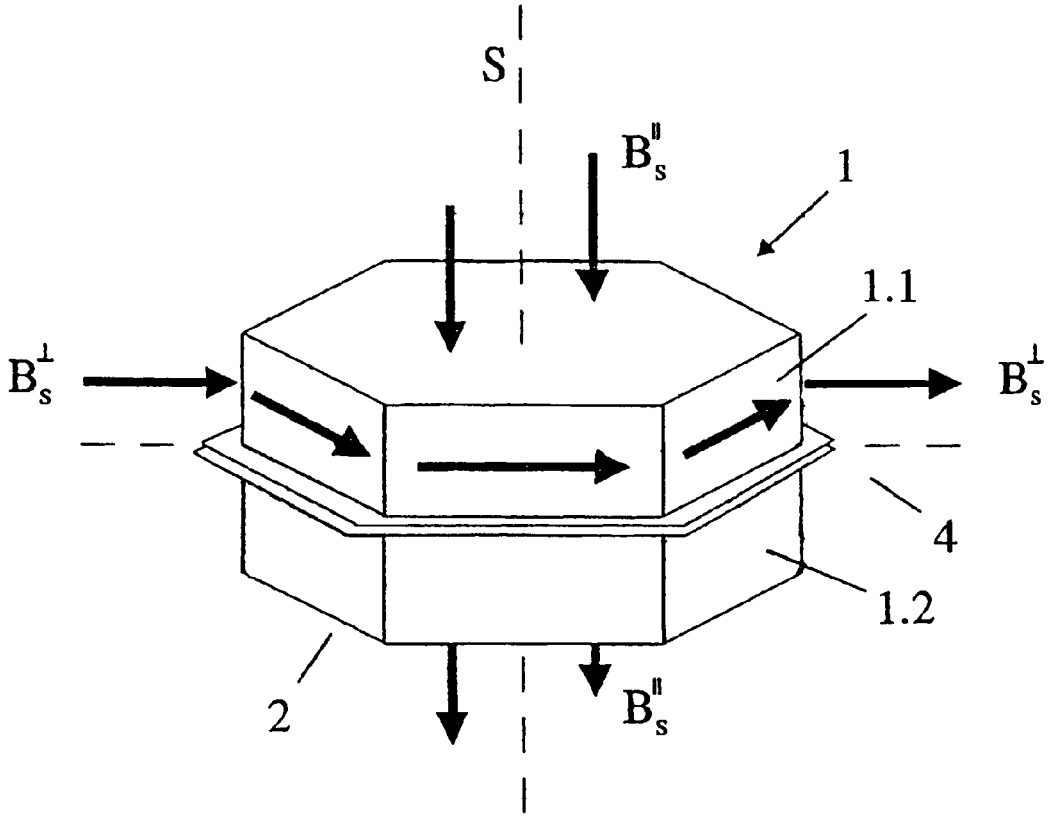

Embodiments of the invention are described by way of non-limiting Examples, with reference to the accompanying drawings, in which:

FIG. 1: shows an external perspective view of the container of the invention;

FIG. 2: shows a cross section through a container in accordance with the invention, which is in pot magnet form and contains a storage cell for spin polarized gases positioned within its interior;

FIGS. 3*a–d*: show various arrangements for boundary field compensation;

FIG. 4: shows a further variant of the container in accordance with the invention;

FIG. 5*a*: shows the curve of the value of the relative, radial gradient $G_r$ in the radial direction R of a pot magnet for different arrangements of the field sources;

FIG. 5*b*: shows the curve of FIG. 5*a* with the scale modified for emphasis;

FIG. 6: shows the relaxation of $^3$He polarization in a storage cell made of glass with a low iron content, whereby the volume of the cell is, for example, 350 cm$^3$ and the gas pressure 2.5 bars;

FIGS. 7*a–b*: demonstrate the removal of a storage cell from a container according to the invention placed within an external field; and FIG. 8: shows a further variant of a container according to the invention which has non-circular cylindrical symmetry.

Referring to FIG. 1, there is shown an external perspective view of a container 1 in accordance with the invention, which in this instance is designed as a two-part cylindrical pot magnet with an upper section 1.1 and a lower section 1.2. Also indicated is the rotationally symmetrical axis S of the pot magnet and the magnetic field line of external magnetic fields, for example the earth's magnetic field. Especially clearly shown is the path of an external magnetic field or stray field $B_s^I$ which does not penetrate into the interior of the pot magnet but, due to the slight magnetic resistance of the yoke 2, which is preferably made of soft iron material, is conducted around the interior space. The stray field $B_s^{II}$ is perpendicular to the end-plates of the yoke and is homogenised by the μ-soft iron pole shoes positioned inside the yoke 2.

FIG. 2 shows an axial cross section through a container for spin polarized gases, especially $^3$He, $^{129}$Xe, as shown in FIG. 1, comprising the container in accordance with the invention and a storage cell for spin polarized gas positioned inside it, which is characterised by extremely long wall depolarization relaxation times.

The pot magnet 1 comprises a cylindrically-formed yoke 2, preferably made of soft iron for returning the magnetic flux and for shielding off external fields. In turn, the cylindrically-formed yoke 2 features two yoke end plates forming a central section 2.1. In the construction form shown, the yoke end plates 2.1 take the form of two circular discs 2.1.1 and 2.1.2. Closed surrounding sheets 2.2 and 2.3 are arranged around the rim of the yoke end plates to form a yoke jacket. These differ in the two construction forms shown in the left and right halves of FIG. 2. The surrounding sheets 2.2 and 2.3 are arranged both on the upper disc 2.1.1 and also on the lower disc 2.1.2, resulting in an upper section and a lower section of the pot magnet, which, in the first construction form shown on the left, meet at the projecting angled peripheral flanges 2.2.1 in the median plane of the magnetic device. In the second construction form shown on the right, the peripheral flanges 2.3.1 are spaced in such a way that an opening for holding field sources, for example permanent magnets, is formed in the median plane 4 of the pot magnet 1. The field line produced due to the positioning of the field sources, for example the permanent magnets, in the centre between the upper and lower peripheral flanges of the pot magnet is identified with 6. In the first construction form shown on the left, the height of the two halves of the yoke jacket 2.2 exceeds the distance between the yoke end plates 2.1.1, 2.1.2. It is possible to position field sources on the outer surface 2.5 in the gap between the jacket and the end plate. The field line in the boundary region which results with such an arrangement is identified with the number 8.

The two opposing pole shoes 10.1 and 10.2 are responsible for the homogeneous field within the interior of the pot magnet. In this example, the pole shoes are essentially designed as homogenising μ-metal plates. μ-metal is a material with a very high homogenising force in relation to an external, stray magnetic field $B_x^{II}$ and is distinguished by very low remanences.

In this example, μ-metal A manufactured by Vacuumschmelze, P.O. Box 2253,63412 Hanau with the following magnetic characteristics is used:

| | | |
|---|---|---|
| Stat. coercivity: | $H_c$ | ≦30 mA/cm |
| Permeability: | $\mu_{(4)}$ | ≧30,000 |
| Maximum permeability: | $\mu_{(max)}$ | ≧70,000 |
| Saturation inductance: | $B_2$ | ≧0.65 T |

(This should not be interpreted as meaning that only this material can be used for the invention). Over the entire pole shoes, the distance between the shoes, and the parallel orientation of the pole shoes may be ensured by the provision of spacer elements or spacer rings, e.g. a total of three (or more) spacers 12, of which only one is shown in FIG. 2.

The resulting homogeneous magnetic field between the pole shoes 10.1 and 10.2, made of μ-metal, is identified with the reference number 14 in this representation. As can be seen from the representation in FIG. 1, a particularly homogeneous magnetic field, independent of external fields, is achieved inside the pot magnet due to the homogenising force of the μ-metal, whereas, in the marginal areas, depending on the arrangement of the field sources, a different field pattern 6 or 8 occurs. If the field sources are arranged solely in the median plane 4, as shown for the right-hand marginal area of the pot magnet 1, then a considerable part of the magnetic flux escapes from the jacket due to the low magnetic resistance and, acting from the edge, interferes with field between the pole shoes, with an amplifying effect. The field therefore increases significantly in intensity towards the edge, as a result of which the desired homogeneity is impaired even where the two pole shoes are a relative short distance apart. Where the permanent magnets are positioned on the outer surface on the end plates of the pot, as shown in FIG. 2 for the left-hand half of the magnet, a significant marginal fall-off f the field is observed between the pole shoes 10.1, 10.2, as shown by the field line 8, because the jacket, which reaches right up to the pole shoes, attracts and weakens the boundary field.

The very homogeneous field 14 produced in the intervening space due to the extremely high permeability of the p-metal plates used as pole shoes 10.1, 10.2 can be increased even further through the introduction of a magnetic resistance 16 between the pole shoes 10.1, 10.2 and the yoke 2.1.1 and 2.1.2. A rigid, non-magnetic plate, for example a plastic plate 16 or, in order to save weight, preferably a honeycomb structure, is preferably used for this purpose. The plate 16 can be bonded to the pole shoes 10.1, 10.2, thus guaranteeing the flatness of the pole shoes 10.1, 10.2.

The storage cell 20 for holding the polarized gas is located in the central mid-section of the pot magnet 1 between the two pole shoes 10.1, 10.2. The container 20 is preferably manufactured of iron-free glass and has an iron concentration of less than 20 ppm, for example, and can also be designed in such a way that it also forms an efficient diffusion barrier against helium. This measure allows wall-related relaxation times of more than 70 hours to be achieved. The storage cells 20 can be pumped out prior to use and, for example, as is usual in high-vacuum technology, heated through until their residual water layers are lost. This measure is advantageous in the invention, but by no means necessary. The storage cells are, for example, sealed with a glass stopcock 22 and are connected to the filling unit for the polarized gas via a glass flange 24.

In addition, in order to determine the degree of polarization, a high-frequency coil 30 (which can be used to subject the storage cell 20 to a time-variant magnetic field) and a detection device (e.g. a magnetic field sensor) 32 can be fitted as may means for moving sensor and storage cell relative to each other. However, these additional fixtures are optional and are by no means essential for a transport device in accordance with the invention.

Furthermore, the container may if desired be fitted with cooling means to cool the contents of the gas storage cell.

The decisive feature of the invention is that a magnetic field is created within the container which is homogeneous over a very large volume, so that a high usable volume is achieved in relation to the total volume of the magnetic device, whereby the homogeneous field within the interior of the magnetic device is essentially not to be interfered with by external magnetic fields. On the one hand, the low magnetic field strength of $B_o$<1 mT which may be used allows a very lightweight construction of the yoke and pole shoes using thin soft iron sheeting. On the other hand, it is desirable that the pole shoes display particularly low remanence, so that these are therefore preferably made of μ-metal in order to fulfil the homogeneity requirement (2).

In terms of being able to determine the degree of polarization, it is advantageous if the homogeneous holding field in the interior of the magnet is a weak magnetic field with a field strength of less than 1.0 mT, since the magnetic fields caused by the spin polarization of the gas, which lie within the nano to micro Tesla range, can then still be measured with sufficient accuracy with the aid of the simple detection device 32 and the degree of polarization determined on this basis. This is advantageous if, for example, the quality of the delivered gas has to be tested prior to a medical application.

Figure 3:
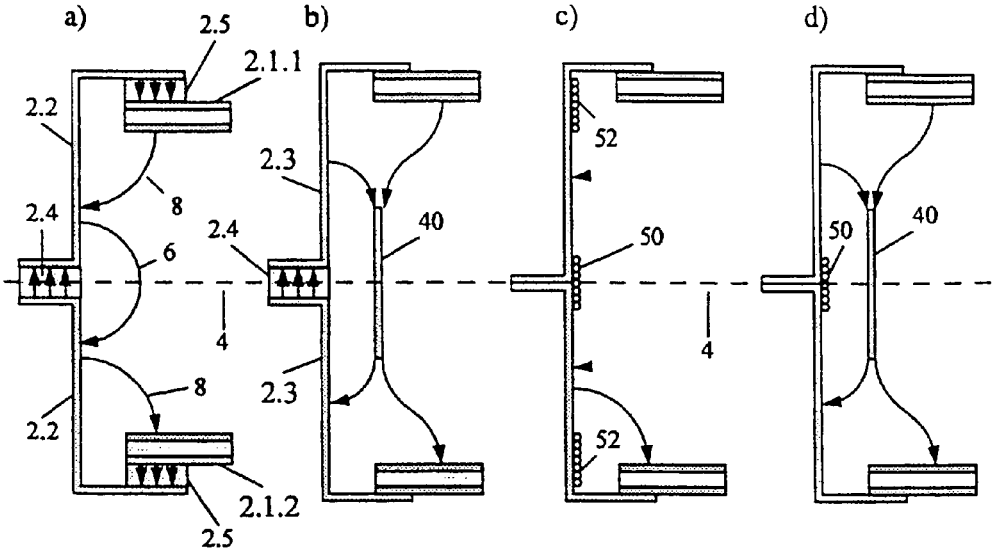

FIG. 3 shows the field distribution within the marginal area achieved by means of different arrangements of field sources, either alone or in combination with a magnetic screen, which guarantees a sufficiently homogeneous field distribution within the marginal area.

FIG. 3*a* shows an arrangement in which the permanent magnets are placed inside the gap 2.4 and inside the gap 2.5 on the end plates of the pot 2.1.1, 2.1.2. By dividing the arrangement of the permanent magnets 2.4. appropriately between arrangement in the centre 4 and arrangement on the end plates of the pot 2.1.1, 2.1.2, the increase in the intensity of the boundary field 6, which is caused by the positioning of the permanent magnets in the centre between the end plates of the pot, as shown, is just compensated by the fall-off in the intensity of the boundary field 8 of the permanent magnets arranged on the end plates of the pot. If the individual permanent magnets are of equal magnetic field strength, an optimal distribution of the permanent magnets is achieved, for the height-to-width ratio of the pot shown in the drawing, if the magnets are distributed in a numerical ratio of 6:8, whereby the first figure represents the number of magnets which are arranged in the median plane 4, and the second figure represents the number of magnets which are arranged on the end plates of the pot.

FIG. 3*b* shows a possible homogenisation of a boundary field using permanent magnets arranged in the median plane 4 with the aid of a magnetic screen 40. A magnetic screen of this sort is, for example, formed by a soft iron ring which is introduced between the pot and the rim of the pole shoe and which, like the sheets 2.2, 2.3, runs around it. Such a soft iron ring partially short-circuits the stray external field and, if appropriately dimensioned, reduces the boundary field to the value of the central field.

FIGS. 3*c* and 3*d* show means of compensation which are comparable with those shown in FIGS. 3*a* and 3*b* where, in this example, magnetic coils 50,52 arranged centrally in the area of the median plane 4 of the pot or in the vicinity of the end plates of the pot are used as field sources instead of permanent magnets.

FIG. 3*c* shows the compensation achieved through a suitable ratio of field sources arranged in the median plane to field sources arranged in the vicinity of the end plates of the pot, and FIG. 3*d* shows the compensation with the aid of a magnetic screen 40.

A further construction form of the invention is shown in FIG. 4. In order to reduce weight, the yoke jacket is constructed of very thin surrounding sheets 200.1, 200.2 and 202.1 and 202.2, in a double-walled construction. The surrounding sheets 200.1, 200.2 and 202.1 and 202.2 are arranged at a fixed distance from one another using spacing rings 207, so that a double shielding of the interior of the pot magnet 1 is achieved. These can be considerably thinner than in a single-walled construction form as shown in FIG. 1, while displaying the same capacity to conduct magnetic fluxes away via the shielding rings. The surrounding sheets are connected with the upper or lower p-metal plate of the pot magnet via a screwed connection 204 or 206. The pole shoes 10.1 and 10.2 are spaced apart by means of spacing elements or a spacing ring 205 which may be circular or polygonal, e.g. hexagonal, in cross-section. The homogeneous magnetic field is essentially formed in the interior 208 between the pole shoes. As in FIG. 3*a*, the permanent magnets 210 fitted in the gap 2.4 between the upper and lower section of the pot magnet and between the jacket and end plate serve as sources for a field which is also homogeneous in the marginal area.

FIGS. 5*a* and 5*b* show the curve of the amount of the relative, radial gradient $G_r=((\delta B_r/\delta_r)/B_o)$ measured 1.5 cm above the reflective plane 4 of the pot magnet in a radial direction r for different arrangements of the permanent magnets in or on the pot magnet in accordance with the invention. The curve marked "a" shows the curve produced when permanent magnets are only arranged in the gap in the median plane 4, as shown in the right half of FIG. 2, and the curve marked "b" shows the curve produced where the permanent magnets are positioned on the outer surface on the end plates of the pot as shown on the left-hand side of FIG. 2. The curve identified with "c" shows the curve of the radial gradient which is produced if the permanent magnets are divided between being positioned on the outer surface and being positioned in the gap in the median plane in accordance with FIG. 3*a*. The numerical ratio between the magnets is 6:8 in the curve shown in curve 3*c*, i.e. 6 magnets were arranged in the centre and 8 on the end plates. In this case, with a gap between the pole shoes of 18 cm and a pole shoe diameter of 40 cm, the homogeneity limit which is represented by the dotted band 400 achieves a value of $G_r=1.5\times10^{-3}$ with r approximately 13 cm, more preferably 12 cm. This limit 400 is displayed over the entire height of the pot magnet, so that a usable transport volume of more than 6 liters, e.g. more than 8 liters is provided within the pot magnet, in which the homogeneity condition $G_r\leqq1.5\times10^{-3}$/cm is fulfilled.

FIG. 6 shows a measurement record of the relaxation of the $^3$He polarization in a storage cell of glass with a low iron content. The volume of the storage cell is 350 cm$^3$, the gas pressure 2.5 bars. As can be seen from this figure, a relaxation time of more than 70 hours is measured through the use of such glasses, whereby the gradient-dependent relaxation time could be ignored under the conditions for this measurement. If one introduces such a receptacle consisting of glass with a low iron content into the pot magnet in the region of the homogenised field, a resulting total relaxation time $T_{res}=(1/T_1^g+1/T_1^w)^{-1}$ of 64 hours is achieved, based on a gradient-dependent relaxation time of $T_1^g=750$ h and a wall-related relaxation time of $T_1^W=70$ h.

The method of the invention for removing a gas stored in a storage cell 20 of a transport device in accordance with the invention in the vicinity of an external magnetic field, for example the stray field $B_{TS}$ of a nuclear magnetic resonance imaging apparatus, is represented in FIGS. 7*a* and *b*. If the storage cell is to be introduced into the field $B_T$ of the magnetic resonance imaging apparatus, for a medical application for instance, without this involving significant depolarization, the invention proposes, as illustrated in FIG. 7*a*, that the transport device in accordance with the invention be set up with its field $B_o$ parallel to and in the same direction as the external magnetic field $B_{TS}$, as shown. The upper part of the transport device facing the magnetic resonance imaging apparatus with the pole shoe 10.1 is then lifted off in the direction indicated by the arrow 302. This makes the storage cell 20 freely accessible. The transport device, designed here in the form of a pot magnet, is shown in its opened state in FIG. 7*b*. As can clearly be seen, the homogenising force is reduced due to the upper section of the pot magnet not being present. Nonetheless, the remaining lower pole shoe 10.2 ensures that the magnetic field lines of the resulting field $B_{res}$ end perpendicular on this pole shoe. This still makes it possible to homogenise the magnetic field $B_{res}$ adequately in the area of the storage cell 20, i.e. to achieve parallel lines of magnetic force, as shown in the drawing. The storage cell can then be removed along arrow 304 in the direction of the symmetrical axis, in the field $B_{res}$ which is still largely homogeneous even with the upper section removed, without a noticeable depolarization of the gas occurring during the brief time taken for removal.

Referring to FIG. 8 there is shown, in perspective, a container according to the invention with hexagonal-cylindrical, rather than circular cylindrical symmetry. Container 1 comprises a hexagonal-cylindrical yoke 2 and has separable upper 1.1 and lower 1.2 portions. Magnetic field sources, pole shoes, etc. may be disposed, e.g. as described for the variants described above, if necessary including shims to combat edge effects to field $B_o$.

The gas contained in the storage cell designed in accordance with the invented method still possesses an adequate degree of polarization for the intended applications after being removed within the strong magnetic field of the nuclear magnetic resonance imaging apparatus.

This invention thus provides a device which allows the storage and transport of spin polarized gases over long distances and periods, such as is required in particular for an intended use in the field of medicine. In particular, the invention is characterised by its economical construction, simple design, maximum possible useable volume and very low weight, whereby reliable shielding against external stray fields is provided. The invention thus provides, for the first time, a means which makes the commercial use of $^3$He and $^{129}$Xe feasible, in the field of medicine for example.

Regarding future possible uses of $^3$He and $^{129}$Xe in medicine, particular reference is made to the use of polarized $^3$He and $^{129}$Xe in brilliant, high-resolution, three-dimensional nuclear magnetic resonance imaging of the human respiratory system.

Regarding this application, reference is made to the following publications, the disclosed content of which is included in full in this application:

Bachert et al., Magnetic Resonance in Medicine 36: 192–196 (1996); and

Ebert et al., THE LANCET 347: 1297–1299 (1996).

In addition, a compact magnet of lightweight construction is presented which provides a magnetic field which is both homogeneous over a wide area, compact, easily transportable and relatively low in cost and which, in particular, also fulfils all requirements in terms of shielding off external magnetic fields which can lead to a depolarization of the nuclear spin. The use of commercially-available small permanent magnets represents a quite decisive advantage in terms of both construction and economy.

In addition, there is the extremely high permeability and low remanence of the p-metal which is in this case used for the first time for the construction of very thin, therefore lighter, and yet highly-efficient pole shoes for the homogenisation of the magnetic field.

The low magnetic flux also allows the use of a yoke made of thin soft iron sheet which, at the same time, due to the pot form and the associated possibility of radial conduction, adequately shields off external interference fields.

This means that, in this invention, a magnet with an extremely favourable ratio of homogeneous field volume to total volume and very low weight is made available for the first time.

In a slightly inferior construction form, pole shoes of magnetically soft iron can be used in place of the p-metal pole shoes which, while reducing the quality of the field, represents a more economical variant in terms of price. It is also possible to replace the permanent magnets with magnetic field coils which fulfil the same function, in order to generate the necessary flux at the points required within the pot magnet.

Finally, a method for removing a spin polarized gas from the pot unit in accordance with the invention is described in which the degree of polarization is also maintained in the presence of external magnetic fields, for example those of a nuclear magnetic resonance imaging apparatus.

The invention claimed is:

1. A magnetically shielded container (1) having disposed in parallel opposed position on an axis (S) thereof magnetic field homogenizing pole shoes (10.1, 10.2), having disposed about said pole shoes a magnetically shielding yoke (2), said-pole shoes and yoke enclosing a magnetic chamber (26), said container further comprising magnetic field sources (2.4, 2.5) disposed about and radially distanced from said axis whereby there exists within said chamber substantially homogeneous magnetic field $B_o$ oriented in the direction of said axis and whereby there is a usable volume within said chamber where the ratio of the magnetic field gradient in the direction transverse to said axis to said magnetic field $B_o$ has a value of no more than $1.5\times10^{-3}$/cm.

2. A container as claimed in claim 1 wherein said ratio has a value of no more than $7\times10^{-4}$/cm.

3. A container as claimed in claim 1 wherein the ratio of said usable volume to the volume of said chamber (26) is greater than 1:30.

4. A container as claimed in claim 1 wherein the ratio of said usable volume to the volume of said chamber (26) is greater than 1:2.

5. A container as claimed in claim 1 wherein the ratio of said usable volume to the volume of said chamber (26) is greater than 1:2.

6. A container as claimed in claim 1 wherein said usable volume is at least 50 ml.

7. A container as claimed in claim 1 wherein said usable volume is at least 100 ml.

8. A container as claimed in claim 1 wherein said usable volume is at least 200 to 2000 ml.

9. A container as claimed in claim 1 wherein said pole shoes (10.1, 10.2) are of μ-metal or soft iron.

10. A container as claimed in claim 1 wherein said yoke (2) is of a material which is not magnetically saturatable at magnetic field strengths below 1 Tesla.

11. A container as claimed in claim 1 wherein said yoke (2) is of a material which is not magnetically saturatable at magnetic field strengths below 2 Tesla.

12. A container as claimed in claim 1 wherein said magnetic field sources (2.5) are disposed around the peripheries of each of said pole shoes (10.1, 10.2).

13. A container as claimed in claim 12 wherein said magnetic field sources are disposed between the side wall (2.2) and end walls (2.1.1, 2.1.2) of said yoke.

14. A container as claimed in claim 1 wherein said magnetic field sources (2.4) are disposed about said axis (S) on a plane (4) between said pole shoes (10.1, 10.2).

15. A container as claimed in claim 14 wherein said magnetic field sources (2.4) are disposed between two sections (2.3) of said yoke (2).

16. A container as claimed in claim 1 wherein one array of magnetic field sources (2.5) is disposed around the peripheries of each of said pole shoes (10.1, 10.2) and a further array of magnetic field sources (2.5) is disposed about said axis (S) on a plane (4) between said pole shoes (10.1, 10.2).

17. A container as claimed in claim 16 wherein said arrays (2.4, 2.5) of magnetic field sources are disposed as defined in claims 12 and 14.

18. A container as claimed in claim 1 further comprising a magnetic screen (40) disposed about said axis (S) within said yoke (2).

19. A container as claimed in claim 1 further comprising at least one shim disposed about said axis (S) within said yoke (2).

20. A container as claimed in claim 1 for which the ratio between the total weight of the container (1) and the volume of the magnetic chamber (26) is no more than 1 kg/l.

21. A container as claimed in claim 1 for which the ratio between the total weight of the container (1) and the volume of the magnetic chamber (26) is no more than 0.2 kg/l.

22. A container as claimed in claim 1 for which the ratio between the total weight of the container (1) and the volume of the magnetic chamber (26) is no more than 1/30 kg/l.

23. A container as claimed in claim 1 which is openable and sealingly closable.

24. A container as claimed in 1 wherein said pole shoes (10.1, 10.2) are circular and said yoke (2) is substantially cylindrical.

25. A container as claimed in claim 1 wherein said pole shoes (10.1, 10.2) are supported by magnetically resistant elements (16).

26. A container as claimed in claim 25 wherein said elements (16) are of rigid porous plastic.

27. A container as claimed in claim 1 further comprising a gas storage cell (20) disposed in said usable volume in said magnetic chamber (26).

28. A container as claimed in claim 27 wherein at least the inner walls of said cell are formed of a material essentially free of paramagnetic substances.

29. A container as claimed in claim 28 wherein said material is a very low iron concentration glass.

30. A container as claimed in claim 29 wherein said glass has an iron concentration of less than 20 ppm.

31. A container as claimed in claim 27 wherein the walls of said cell (20) are uncoated.

32. A container as claimed in claim 27 wherein the wall of said storage cell (20) is of a low iron content glass, the iron content being sufficiently low that the ratio between the wall-related depolarization relaxation time $T_1^w$ for nuclear spin polarized $^3$He and the volume-to-inner surface area of said cell is at least 10 hours/cm.

33. A container as claimed in claim 27 wherein said cell (20) is provided with a valve (22) to permit introduction and removal of gas.

34. A container as claimed in claim 27 wherein said cell (20) contains nuclear spin polarized gas.

35. A container as claimed in claim 34 wherein said gas is $^3$He or $^{129}$Xe or contains $^{19}$F, $^{13}$C or $^{31}$P.

36. A container as claimed in claim 27 wherein said cell (20) has an internal volume of at least 50 ml.

37. A container as claimed in claim 27 wherein said cell (20) has an internal volume of between 100 ml and 1 l.

38. A container as claimed in claim 1 in transportable form.

39. A container as claimed in claim 1 further comprising a magnetic field sensor (32) disposed within said magnetic chamber (26).

40. A container as claimed in claim 39 further comprising means for moving said sensor (32) relative to a gas storage cell (20) disposed in said magnetic chamber (26).

41. A container as claimed in claim 39 further comprising a source (30) for a time variant magnetic field disposed in said magnetic chamber (26).

42. A container as claimed in claim 1 further comprising a spacer (12, 205) so disposed as to maintain said pole shoes (10.1, 10.2) in parallel opposed relationship.

43. A container as claimed in claim 1 having a double-hulled (200.1, 200.2) construction whereby said yoke (2) is provided at least in part by the inner hull (200.2).

44. A container as claimed in claim 1 in the form of a magnetic device (1) with an internal space which provides a high-volume, largely homogeneous, shielded magnetic field within its interior, whereby the magnetic device (1) features homogenising μ-metal plates as pole shoes (10.1, 10.2), wherein a ratio of 1:1.5 can be achieved between the useable volume of the magnetic device within which a homogeneous magnetic field is present and the overall volume of the magnetic device and the homogeneity condition $$G_r \leqq 1.5\times10^{-3}/\text{cm}$$

is fulfilled within the useable volume, whereby $G_r$ is the relative transverse magnetic field gradient.

* * * * *

UNITED STATES PATENT AND TRADEMARK OFFICE

CERTIFICATE OF CORRECTION

PATENT NO. : 7,176,386 B1
APPLICATION NO. : 09/509317
DATED : February 13, 2007
INVENTOR(S) : Elke Aidam et al.

It is certified that error appears in the above-identified patent and that said Letters Patent is hereby corrected as shown below:

Column 4, lines 48, 49 and 57 the measure of units "mL" should read --ml--;

Column 6, line 22 the word "Examples" should read --examples--;

Column 6, line 53 the word "is" should read --are--;

Column 6, line 57 "stray field $B_S^{I}$" should read --stray field $B_S^{\perp}$--;

Column 6, line 60 "stray field $B_S^{II}$" should read --stray field $B_S^{\parallel}$--;

Column 12, line 15, Claim 1 "said-pole" should read --said pole--;

Column 12, line 19, Claim 1 "$B_o$" should read --$B_O$--; and

Column 12, line 31, Claim 1 "1:2" should read --1:5--.

Signed and Sealed this

Nineteenth Day of June, 2007

JON W. DUDAS
*Director of the United States Patent and Trademark Office*